US006361195B1

(12) United States Patent
Natsume

(10) Patent No.: US 6,361,195 B1
(45) Date of Patent: Mar. 26, 2002

(54) VEHICLE LAMP AND METHOD OF DETERMINING REFLECTIVE SURFACE OF REFLECTOR THEREOF

(75) Inventor: Kazunori Natsume, Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 0 days.

(21) Appl. No.: 09/676,566

(22) Filed: Oct. 2, 2000

(30) Foreign Application Priority Data

Oct. 1, 1999 (JP) ..... 11-281681

(51) Int. Cl.[7] ..... F21V 7/00

(52) U.S. Cl. ..... 362/518; 362/517; 362/516; 362/297; 362/346

(58) Field of Search ..... 362/518, 516, 362/517, 297, 346, 520, 521, 522, 309; 356/446, 121

(56) References Cited

U.S. PATENT DOCUMENTS

| | | | | |
|---|---|---|---|---|
| 4,481,563 A | | 11/1984 | Snyder et al. | 362/296 |
| 4,495,552 A | | 1/1985 | Graff | 362/297 |
| 4,959,757 A | | 9/1990 | Nakata | 362/459 |
| 5,065,287 A | | 11/1991 | Staiger et al. | 362/459 |
| 5,452,191 A | | 9/1995 | Lopez | 362/297 |
| 5,567,044 A | * | 10/1996 | Lopez | 362/517 |
| 5,655,828 A | | 8/1997 | Yamamoto et al. | 362/459 |
| 5,707,141 A | | 1/1998 | Yamamoto et al. | 362/305 |
| 5,836,668 A | | 11/1998 | Ishikawa et al. | 362/459 |
| 5,876,114 A | * | 3/1999 | Nino | 362/518 |
| 6,186,652 B1 | * | 2/2001 | Fadel | 362/518 |
| 6,224,246 B1 | | 5/2001 | Natsume et al. | 362/518 |

FOREIGN PATENT DOCUMENTS

| | | | |
|---|---|---|---|
| EP | 0 257 946 A2 | 3/1988 | F21M/3/08 |
| GB | 2 304 882 A | 3/1997 | F21M/3/08 |
| JP | 09033708 | 2/1997 | G02B/5/10 |
| JP | 11-265607 | 9/1999 | F21Q/1/00 |

* cited by examiner

*Primary Examiner*—Sandra O'Shea
*Assistant Examiner*—Ronald E. DelGizzi
(74) *Attorney, Agent, or Firm*—Sughrue Mion, PLLC

(57) ABSTRACT

A reflective surface 10*a* of a reflector 1 in a vehicle lamp is formed in such a way that a free-formed surface 20 is created as a basic shape so as to satisfy light uniformity out of functional conditions and thin shape as a shape condition and that a reflective surface element 14 created so as to satisfy light diffusibility out of the functional conditions and transparency as an appearance condition is assigned to each of segments obtained by dividing the free-formed surface 20 into an array pattern. Particularly, the free-formed surface 20 or the reflective surface 10*a* is created so that luminous exitances M specified in a direction along the optical axis satisfy the condition of Mmax/Mmin≦6, whereby the above conditions can be suitably substantiated. Thus, the vehicle lamp improved in functional conditions of light uniformity and light diffusibility while being provided with transparent appearance and thin shape, and the method of determining the reflective surface of the reflector thereof can be realized.

11 Claims, 9 Drawing Sheets

VEHICLE LAMP AND METHOD OF DETERMINING REFLECTIVE SURFACE OF REFLECTOR THEREOF

BACKGROUND OF THE INVENTION

1. Field of the Invention

The present invention relates to a vehicle lamp used in vehicles, such as automobiles and the like, and to a method of determining a reflective surface of a reflector thereof.

2. Related Background Art

The vehicle lamps need to meet (1) the conditions from the aspect concerning the function as lamps and, in addition thereto, (2) the conditions from the aspect concerning the shape (shape constraints) and (3) the conditions from the aspect concerning the appearance (appearance constraints) because of their use in a mounted state on the vehicles such as the automobiles and the like. It is thus necessary to realize lamps optimized as to the conditions from the functional aspect while satisfying the given constraints from the shape aspect and the appearance aspect.

The conditions from the functional aspect include light uniformity with which the entire lamp lights uniformly, light diffusibility with which light is properly diffused to be observed from various directions, and so on, depending upon types of lamps.

As for the constraints from the vehicle and body side, the shape constraints include conditions defined by the volume and shape of lamp receiving portions of the body, the continuous shape of the outer surface of the lamp (the outer surface of lens) from the other body portions, and so on. The appearance constraints include conditions resulting from harmony with the appearance of the other body portions, requirements from the design aspect of the body, and so on.

SUMMARY OF THE INVENTION

With the recent trend toward fascinating styling of cars, there are increasing needs for vehicle lamps matching further various body-side constraints, according to forms of individual vehicles, types of lamps including illumination lamps, marker lamps, etc., and so on. An example of such lamps is a marker lamp that appears transparent and deep, because the lens forming the outer surface of the lamp is one with see-through nature.

An example of the conventional marker lamps of this type is a structure in which the reflective surface of the reflector for reflecting the light from the light source is formed in a unifocal paraboloid shape, the reflective surface is divided into an array pattern of segments, and the segments are provided with diffuse reflection steps for diffusely reflecting the light from the light source. In this case, since the light is diffused at the reflector, the lens does not have to diffuse the light much. As a consequence, the lens can be a stepped lens or a stepless lens with see-through nature, which realizes transparency as one of the appearance constraints described above.

In the case of the lamp in the above structure, however, the thickness of the lamp can not be decreased, because the basic shape of the reflective surface is based on a single paraboloid. It is thus difficult to match the lamp with the shape constraint of decrease in the depth of the lamp according to the volume of the lamp receiving portion of the body. In addition, it also fails to assure sufficient light uniformity of emitted light in the functional aspect.

Another marker lamp is one constructed in such structure that the basic shape of the reflective surface is a free-formed surface determined from the shape constraints and that a plurality of paraboloids of revolution are arranged in order in an approximately concentric circle pattern about the light source and the optical axis on the free-formed surface. In this case, it is relatively easy to meet the shape constraints including the decrease in the depth of the lamp, because the structure provides sufficiently large degrees of freedom in designing (for example, reference is made to Japanese Patent Application Laid-Open No. H09-33708).

In the above structure, however, the light reflected by the reflective surface is nearly parallel light without diffuse reflection, because the reflection employed is one by the paraboloids of revolution. In addition, it is necessary to diffuse the light with a fish-eye stepped lens or the like as the lens, and thus the lens lacks of the see-through nature, so as to fail to obtain the transparency as one of the appearance constraints.

The present invention has been accomplished in view of the above problems and an object of the present invention is thus to provide a vehicle lamp of thin shape and appearance with transparency while being improved in the functional conditions of light uniformity and light diffusibility, and provide a method of determining a reflective surface of a reflector in the vehicle lamp, which permits efficient determination of the shape of the reflective surface of the reflector capable of realizing the lamp satisfying such conditions.

In order to accomplish the above object, a method of determining a reflective surface of a reflector used in a vehicle lamp according to the present invention is a method comprising: (1) a condition setting step of setting a light source position at which a light source is to be placed, and an optical axis passing the light source position and defining a direction into which light from the light source is to be reflected by the reflector; (2) an initial reference line setting step of setting a plurality of initial reference lines each extending radially from a predetermined position on the optical axis so that on each of the initial reference lines luminous exitances M, specified in the direction along the optical axis for respective portions of the initial reference line, are constant; (3) a surface reference line creating step of creating a plurality of surface reference lines by deforming the plurality of initial reference lines so as to satisfy the condition of $Mmax/Mmin \leqq 6$ as to a maximum Mmax and a minimum Mmin on the plurality of initial reference lines out of luminous exitances M for the respective, entire, initial reference lines, and a predetermined shape constraint; (4) a free-formed surface creating step of creating a free-formed surface comprising the plurality of surface reference lines; and (5) a reflective surface determining step of dividing the free-formed surface into an array of segments and assigning a reflective surface element having a diffuse reflection region for diffusely reflecting the light from the light source position, to each of the segments, thereby determining a reflective surface comprising a plurality of reflective surface elements.

Also, a vehicle lamp according to the present invention is a vehicle lamp comprising a light source, a reflector having a reflective surface comprising a plurality of reflective surface elements for reflecting light from the light source into a direction along a predetermined optical axis, and a lens which transmits the light reflected by the reflector, wherein the reflective surface is formed by assigning the reflective surface elements to respective segments obtained by dividing a free-formed surface satisfying a predetermined shape constraint, into an array pattern, and each of the plurality of reflective surface elements has a diffuse reflection region for diffusely reflecting the light from the light source, and wherein the free-formed surface satisfies the condition of Mmax/Mmin≦6 as to a maximum Mmax and a minimum Mmin out of luminous exitances M specified in the direction along the optical axis for respective portions on the free-formed surface.

Another vehicle lamp according to the present invention is a vehicle lamp comprising a light source, a reflector having a reflective surface comprising a plurality of reflective surface elements for reflecting light from the light source into a direction along a predetermined optical axis, and a lens which transmits the light reflected by the reflector, wherein the reflective surface is formed by assigning the reflective surface elements to respective segments obtained by dividing a free-formed surface satisfying a predetermined shape constraint, into an array pattern, and each of the plurality of reflective surface elements has a diffuse reflection region for diffusely reflecting the light from the light source, and wherein the reflective surface comprising the plurality of reflective surface elements satisfies the condition of Mmax/Mmin≦6 as to a maximum Mmax and a minimum Mmin out of luminous exitances M specified in the direction along the optical axis for respective portions on the reflective surface.

In order to realize the thin vehicle lamp with light uniformity and light diffusibility and with transparency and a deep look, it is necessary to provide the reflector with sufficient light diffusing capability and thereby relax the light diffusing capability required of the lens, thus permitting application of the lens with see-through nature, and to determine the shape of the reflective surface of the reflector so as to satisfy the conditions of light uniformity and light diffusibility and the condition of decrease in the depth of the lamp. The lens with see-through nature herein means a lens with low light diffusing capability through which the reflective surface of the reflector can be seen over a certain level; for example, a lens with diffuse steps for diffusing light only in one direction, and a lens without diffuse steps.

For determining the shape of this reflective surface, the above determining method employs the free-formed surface as the basic shape of the reflective surface instead of the paraboloid of revolution and thereby meets the condition of light uniformity out of the conditions from the functional aspect, and the condition of decrease in the depth as a shape constraint. Further, the method adopts the reflective surface elements formed in the respective segments obtained by dividing the free-formed surface into the array pattern, and thereby satisfies the condition of light diffusibility out of the conditions from the functional aspect, and the condition of transparency as an appearance constraint, thus determining the shape of the reflective surface for the lamp satisfying all the above conditions.

Particularly, the inventor discovered that the luminous exitance M in each part was extremely useful as an index for determination of the shape in order to improve the functional conditions of the lamp as to the shape of the reflective surface, particularly, the light uniformity. When the shape of the reflective surface is determined by applying values of the luminous exitance M for shape determination, deformation, etc. and properly setting the numerical range thereof, it becomes feasible to improve the condition of light uniformity, and compatibility between the light uniformity and the other conditions and to greatly increase the efficiency of the determining method and design steps.

The luminous exitance M herein is specified in the direction along the optical axis as described above and indicates quantity of luminous flux emitted per unit area (unit field area) in a view from the direction of the optical axis. A specific determination method of the luminous exitance is as follows. A reference plane is first defined as a plane normal to the optical axis, regions of unit areas on the reference plane are projected onto a curved surface of object (including a surface comprised of an assembly of plural curved surfaces) such as the free-formed surface or the reflective surface, and regions resulting from the projection are used as unit regions with respect to the optical axis on the curved surface. Then the luminous exitance M is defined as quantity of incident light from the light source into each of the unit regions. Since the quantity of incident light to each region is equal to quantity of light reflected and emitted from that region, the luminous exitance M defined as described above can be used as a suitable criterion for determining the quantity of reflected light from that region and the light uniformity in each part.

The reason why the luminous exitance M is defined as the quantity of light per unit area on the reference plane is that this reference plane is equivalent to the field where the lamp in an on state is observed from the optical-axis direction. Thus the light uniformity under practical use of the lamp can accurately be judged or adjusted from this luminous exitance M. The luminous exitance for each part (each segmental part of region) or the whole of the object is calculated by dividing the quantity of incident light to each part or to the entire region by the area on the reference plane to obtain the quantity of incident light per unit area.

Further, the inventor found out about the reflective surface determining method with attention to numerical distribution of luminous exitances M in respective parts, that it became feasible to efficiently and accurately determine the shape of the curved surface with improved light uniformity and light diffusibility while satisfying the various conditions, by use of a plurality of reference lines each extending radially from the optical axis.

Specifically, when a plurality of radial, initial reference lines are first set so as to make the luminous exitances M for the respective parts constant on each line, and when the free-formed surface is formed via the surface reference lines, based on the initial reference lines, the determining method can be simplified in the step of determining the shape of the reflective surface complying with the shape constraints including the decrease in the depth while satisfying the light uniformity.

For example, it is also possible to create the reference lines as a plurality of vertical curves and connect them in the lateral direction to form a curved surface. In view of the relation of the light source and the optical axis with the curved surface, use of such a method will complicate the procedures of determination of shape and result in failing to gain satisfactory characteristics. In contrast to it, the employment of radial reference lines facilitates the determining method and also improves the characteristics of the free-formed surface and the reflective surface obtained by this method. When the free-formed surface is created from the surface reference lines, it is desirable to create smooth free-formed curves from the respective surface reference lines so as to remove steps etc. on the surface, for example, by use of spline curves or the like.

Speaking here of realization of the preferred condition of Mmax/Mmin≦6 of the luminous exitances M for the entire reference lines, when this condition is applied to the luminous exitances M on the plurality of surface reference lines, conditions to substantially meet the condition of Mmax/Mmin≦6 can also be realized as to the luminous exitances M for the respective portions in the created free-formed surface and reflective surface. Alternatively, the shape of the reflective surface can also be determined by further imposing the above condition on the free-formed surface or on the reflective surface.

The present invention will be more fully understood from the detailed description given hereinbelow and the accompanying drawings, which are given by way of illustration only and are not to be considered as limiting the present invention.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will be apparent to those skilled in the art from this detailed description.

DESCRIPTION OF THE PREFERRED EMBODIMENTS

Figure 1:
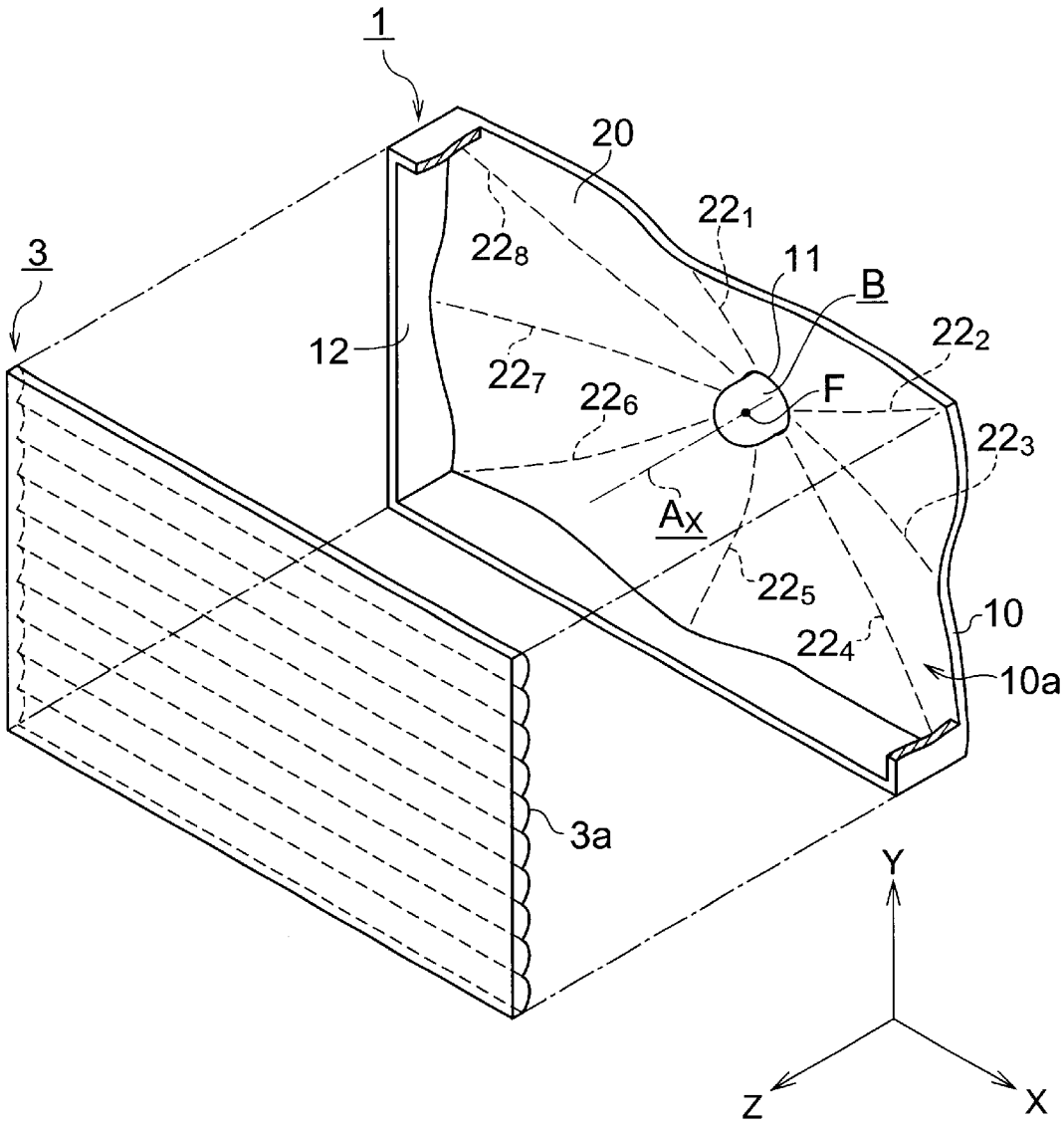
FIG. 1 is an exploded perspective view, partly broken, of the structure of an embodiment of the vehicle lamp.

The preferred embodiments of the vehicle lamp and the reflective surface determining method of the reflector thereof according to the present invention will be described below in detail with reference to the drawings. The same elements will be denoted by the same reference symbols in the description of drawings and redundant description will be omitted. It is also noted that dimensional ratios in the drawings do not always exactly match those in the description.

First described is the schematic structure of the vehicle lamp according to the present invention.

Figure 2:
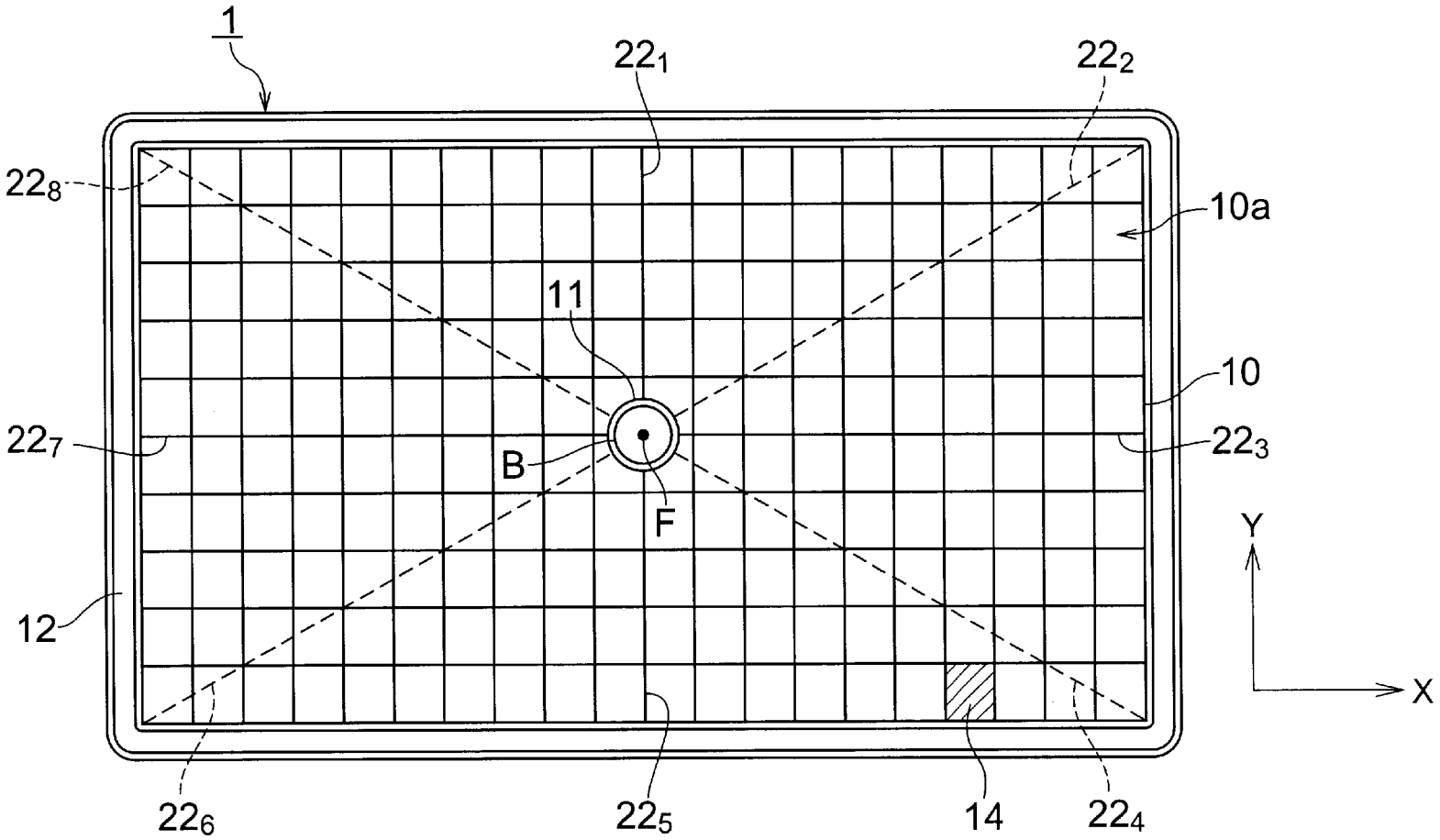
FIG. 2 is a plan view to show the structure of the reflector in the vehicle lamp illustrated in FIG. 1.

FIG. 1 is an exploded perspective view, partly broken, of the structure of an embodiment of the vehicle lamp according to the present invention. FIG. 2 is a plan view to show the structure of the reflector in the vehicle lamp illustrated in FIG. 1. In FIG. 1, the structures of fixing and positioning portions of the reflector and lens are omitted from the illustration. In the description below, the X-, Y-, and Z-coordinate axes are defined as illustrated in FIG. 1 and FIG. 2; the X-axis is taken along the lateral direction of the lamp, the Y-axis along the vertical direction, and the Z-axis along the depthwise direction, which is the direction of the optical axis Ax of the lamp.

The vehicle lamp of the present embodiment can be applied, for example, to the marker lamps such as tail lamps of automobiles and the like, and this lamp is constructed with the reflector 1 and the lens 3, as illustrated in FIG. 1.

The reflector 1 is formed so as to spread in directions approximately normal to the optical axis Ax, which is preset from the longitudinal direction of the vehicle to which the lamp is to be mounted, and the light projecting direction of the lamp, and is formed in an almost rectangular shape in a view from the direction of the Z-axis. The reflector 1 has a reflector part 10 a surface of which opposite to the lens 3 placed in front thereof along the optical axis Ax is a reflective surface 10*a* for reflecting light, and a rim part 12 for positioning and fixing to the lens 3, which is structured so as to enclose the reflective surface 10*a*. A light-source bulb B is inserted into a light-source inlet 11 bored at the almost center position in the reflector part 10 and is fixed relative to the reflector 1 so that the illuminant point F thereof is located at a predetermined position (light source position) on the optical axis Ax. The lens 3 is set nearly perpendicular to the optical axis Ax.

It is noted herein that the present embodiment provides an example for the various conditions, including the peripheral shape of the approximately rectangular shape of the reflector 1 (the outline shape of the rim part 12), the setting angle of the lens 3 relative to the optical axis Ax, the location of the light-source bulb B, and so on. In general, those conditions are appropriately set in consideration of the shape constraints imposed from the body side, including the volume and shape of the lamp receiving part of the body, the continuous shape of the outer surface of the lamp (the outer surface of the lens) from the other body portions. There are no particular restrictions on specific production methods of producing the reflective surface 10*a* of the reflector 1, and the embodiment described below can be applied to lamps provided with reflectors formed by various production methods.

In FIG. 1, the reflector 1 and lens 3 forming the vehicle lamp are illustrated in a disassembled state and the shape of the reflective surface 10*a* is shown by partly breaking the upper and right portions (in the figure) of the rim part 12 of the reflector 1. In this FIG. 1, however, the array of reflective surface elements 14 (see FIG. 2) forming the reflective surface 10*a* are not illustrated and the surface shape thereof is schematically shown by the free-formed surface 20, which is the basic shape of the reflective surface 10*a*. Eight dashed lines on this free-formed surface 20 are surface reference lines $\mathbf{22}_1$ to $\mathbf{22}_8$ used for creation and setting of the free-formed surface 20.

The free-formed surface 20 is a curved surface used for determination of the shape of the reflective surface, as a surface to specify the basic shape of the reflective surface 10*a*. The basic shape is not a single paraboloid of revolution, but the free-formed surface selected as a curved surface satisfying the shape constraints and also satisfying certain conditions, e.g., such a condition that the luminous exitances (described hereinafter) from the respective parts on the curved surface are values within a predetermined range. Namely, the free-formed surface 20 is of the structure satisfying the condition of light uniformity out of the conditions from the functional aspect and the thin shape as one of the shape constraints from the body side.

The reflective surface 10*a* is formed by assigning a plurality of reflective surface elements 14 (individual sections of the rectangular shape in FIG. 2) to respective segments obtained by dividing the free-formed surface 20 of the basic shape into an array pattern as illustrated in FIG. 2. In FIG. 2, one of the reflective surface elements 14 is hatched in order to clarify the range thereof. In the present embodiment the reflective surface 10*a* is constructed in the divided structure of the segments at fixed intervals in the X-axis direction and in the Y-axis direction normal to each other so that the shapes of the segments corresponding to the respective, reflective surface elements 14 are same and rectangular in a view from the Z-axis direction.

A shape of a basic reflective surface of the reflective surface element 14 is determined for each of the segments in the divided condition as described above. The shapes of the basic reflective surfaces are determined as paraboloids of revolution generated with respective, different focal lengths, using the optical axis Ax as a center axis and the illuminant point F (light source position) as a focus. The focal lengths of the paraboloids of revolution in the respective, reflective surface elements 14 are determined from the illuminant point F and the optical axis Ax and from the positions of the reflective surface elements 14 on the free-formed surface 20 so that the light from the illuminant point F is reflected into the direction of the optical axis Ax.

Further, the reflective surface shape of each reflective surface element 14 is set with a diffuse reflection region obtained by deforming the whole or part of the shape of the paraboloid of revolution so as to yield predetermined light diffusing capability. The light diffusing capability herein is the capability of diffusing the light emitted from the lamp, not in the form of parallel light in the optical-axis direction, but in the form of light spreading in a predetermined angular range along the optical axis.

When the reflective surface 10*a* is constructed of the reflective surface elements 14 obtained by dividing the free-formed surface 20 of the basic shape into the array of segments and when each reflective surface element 14 is provided with the light diffusing capability as described above, it becomes feasible to apply the lens 3 with see-through nature and with low light diffusing capability to the lens that transmits the light from the reflective surface 10*a* to the outside of the lamp. Namely, each of the reflective surface elements 14 is formed in the structure satisfying the condition of light diffusibility out of the conditions from the functional aspect and the transparency and deep look as appearance constraints from the body side.

When the reflective surface 10*a* is constructed by forming the plurality of reflective surface elements 14 on the free-formed surface 20 as described above, the lamp is efficiently realized to satisfy all the conditions required of this vehicle lamp, i.e., all of the conditions of light uniformity and light diffusibility from the functional aspect, the condition of decrease in the depth from the shape aspect, and the condition of transparency from the appearance aspect.

Figure 3:
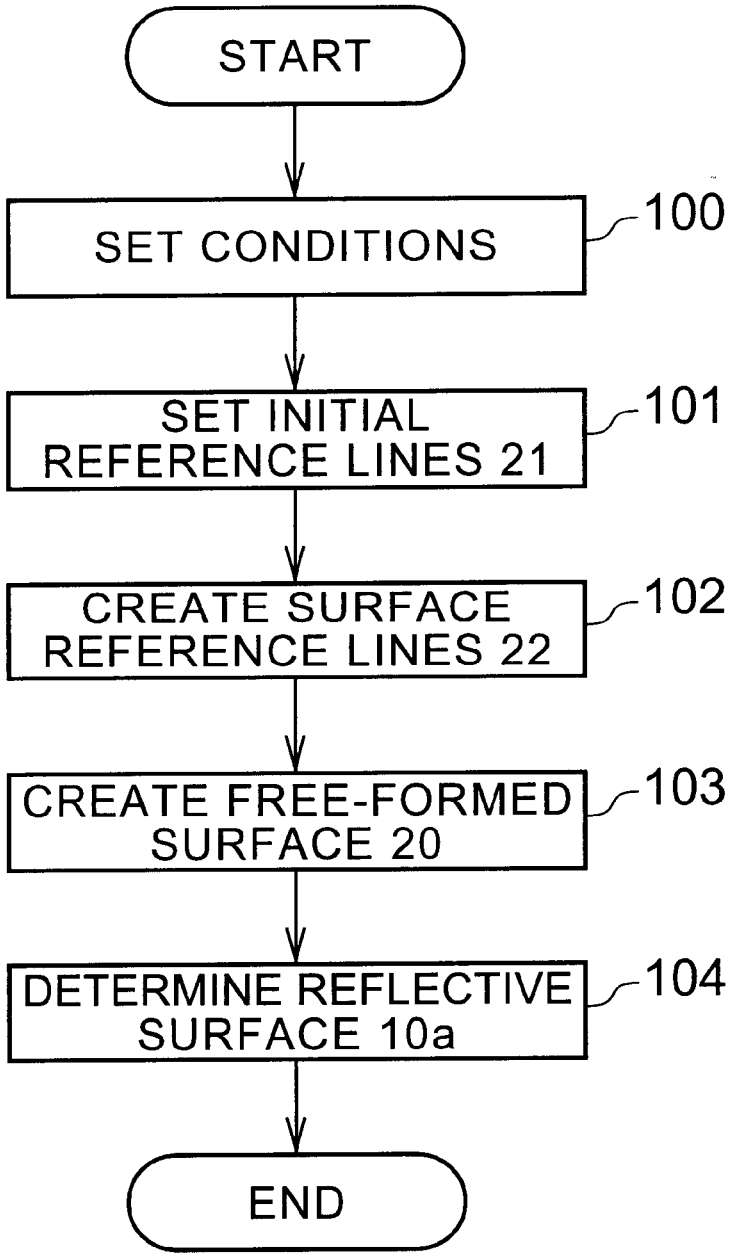
FIG. 3 is a flowchart to show the reflective surface determining method of the reflector.

Next described are specific construction conditions of the above vehicle lamp, together with the reflective surface determining method of the reflector. The shape determining method of the reflective surface 10*a* of the reflector 1 used in the vehicle lamp according to the present invention has the following steps; condition setting step 100, initial reference line setting step 101, surface reference line creating step 102, free-formed surface creating step 103, and reflective surface determining step 104, as illustrated in the flowchart in FIG. 3.

[Condition Setting Step] (Step 100)

Various conditions necessary for the determination of shape are first set in the determination of the shape of the reflective surface of the reflector used in the vehicle lamp.

The set conditions are, for example, the position where the light-source bulb B is located and the position of the illuminant point F thereof (light source position), the optical axis Ax which is an axis passing the light source position and which specifies a direction into which the light from the light source is reflected by the reflective surface to be emitted from the lamp, and so on.

Other conditions may also be set or designated if necessary. For example, a light emission distribution from the light source may also be given as a condition by a distribution corresponding to the filament structure of the light-source bulb B applied in practice. Besides the set conditions, the shape constraints from the body side and other conditions are preliminarily imposed on the lamp or the reflector.

[Initial reference line setting step] (Step 101)

The next step is a step of setting the initial reference lines as a basis of the surface reference lines $\mathbf{22}_1$ to $\mathbf{22}_8$ (see FIG. 1 and FIG. 2) for creation of the free-formed surface 20 being the basic shape of the reflective surface 10*a,* i.e., as an initial condition for determination of the reflective surface 10*a*.

Figure 4:
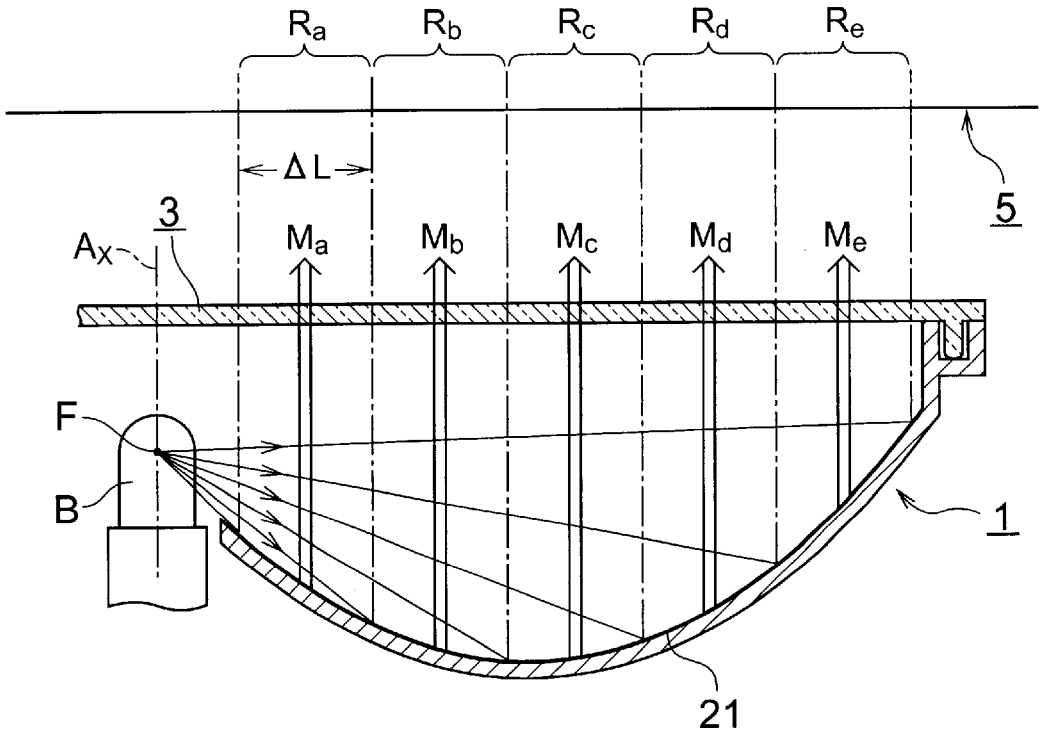
FIG. 4 is a cross-sectional view of the lamp shape for explaining the setting method of initial reference lines of the reflector.

FIG. 4 is a cross-sectional view by a plane being parallel to the optical axis Ax and including an initial reference line 21 of the lamp shape assumed in this step 101 (which is different from the lamp shape actually produced), for explaining the setting method of initial reference lines 21.

For creation of the free-formed surface 20, n lines (n is two or more) are set as initial reference lines having first ends at a predetermined position on the optical axis Ax, which passes the center (the light source position or the illuminant point F) of the light-source bulb B, and extending radially therefrom. Each of the initial reference lines 21 is created as a curve in a plane including the optical axis Ax, as illustrated in FIG. 4, and the number and the radially extending directions of the reference lines used for the determination of shape are set from the shape constraints imposed on each lamp and other design conditions.

For example, n=8 in the embodiment illustrated in FIG. 1 and FIG. 2, and thus the free-formed surface 20 is created using totally eight surface reference lines: two surface reference lines $\mathbf{22}_1$ (upward) and $\mathbf{22}_5$ (downward) extending in the Y-axis direction from the optical axis Ax, two surface reference lines $\mathbf{22}_3$ (rightward) and $\mathbf{22}_7$ (leftward) extending in the X-axis direction, and four surface reference lines $\mathbf{22}_2$ (obliquely right upward), $\mathbf{22}_4$ (obliquely right downward), $\mathbf{22}_6$ (obliquely left downward), and $\mathbf{22}_8$ (obliquely left upward) extending in diagonal directions. Therefore, the eight initial reference lines are set as an initial condition for them. However, the other ends to the first ends on the optical axis Ax side do not always have to be located on the peripheral range of the lamp, but the length of each initial reference line may be determined within a preferred range for creation of the free-formed surface 20.

Each initial reference line 21 is determined by the positions of the start point on the optical axis Ax side and the end point on the other side and by the condition that the luminous exitances M in the respective portions on the initial reference line 21 are constant on each reference line.

The luminous exitance M is defined in the direction along the optical axis and is equivalent to the quantity of light from each part in the field where the lamp in the on state is observed from the optical-axis direction. When this luminous exitance M is used as an index to evaluate the light reflection characteristics, particularly, the light uniformity, it becomes feasible to improve the condition of light uniformity and the compatibility between the condition of light uniformity and the other conditions.

More specifically, a reference plane 5 (see FIG. 4) used in determination of the luminous exitance M is defined as the X-Y plane normal to the optical axis Ax, and each region as a unit area in the reference plane 5 is projected onto a curved surface of object, e.g., onto the free-formed surface 20, to be defined as a unit region on the curved surface. Then the luminous exitance M in each part is defined by the quantity of light incident from the light-source bulb B into that unit region. Since the quantity of light reflected from each unit region is nothing but this quantity of incident light, the luminous exitance M can be specified by the quantity of incident light and the value thereof can be utilized for determination of the shape of the reflective surface 10*a*, thereby determining the quantity of light emitted from that region and being used as a criterion for improvement in the condition of light uniformity.

The luminous exitance M for each part or the whole of the region can be determined by dividing the quantity of incident light to each part (each of portions obtained by dividing the region) or the entire region as an object, by the area thereof on the reference plane, to obtain the quantity of incident light per unit region corresponding to the unit area on the reference plane.

In determination of the curve shape of the initial reference lines 21, each initial reference line 21 is set in such a way that the initial reference line 21 is divided into equally long portions on a projection on the reference plane and that the luminous exitances M from the respective portions are constant. However, since the luminous exitances herein are not those on a curved surface, but those on a curve, small regions of equal areas on the reference plane are hypothetically set near the respective regions equally long on the initial reference line 21 and the luminous exitances M are determined in the respective regions. FIG. 4 shows an example in which each line is divided into five portions to evaluate and compare the luminous exitances M therein. Specifically, five regions Ra, Rb, Rc, Rd, Re of equal width AL are set on the reference plane 5, as illustrated, for the initial reference line 21, and the curve shape of the initial reference line 21 is determined so that the luminous exitances Ma, Mb, Mc, Md, and Me from the respective regions become constant.

In this determination and evaluation of the luminous exitances M, it is desirable to determine each of the luminous exitances Ma to Me in consideration of not only the positions of the light-source bulb B and the illuminant point F thereof, but also the light emission distribution or the like differing depending upon the light source shape of the light-source bulb B used in the lamp.

Figure 5:
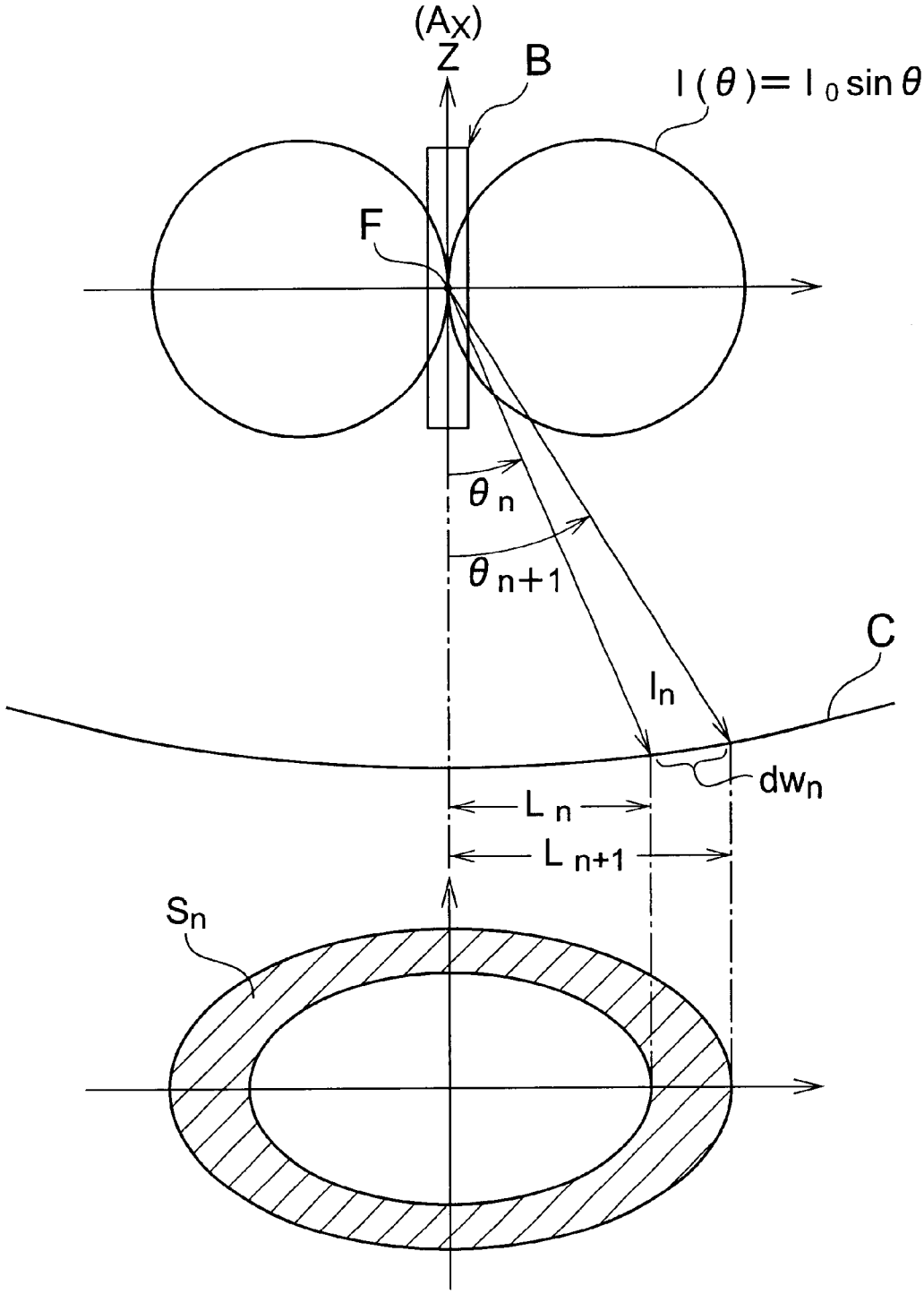
FIG. 5 is a diagram for explaining light emission distribution and luminous exitance from a line segment light source.

As an example of the determination of the luminous exitances M, the following will describe a case in which the light source part of the light-source bulb B is a line segment light source with a filament having a fixed length along the optical axis Ax (see FIG. 5). At this time, luminous intensity of emitted light is dependent upon an angle θ from the optical axis Ax (θ=0 is defined hereinafter on the reflective surface side as illustrated in FIG. 5) and intensity distribution I(θ) of luminous emission is given by the following equation.

$$I(\theta)=I_0 \sin \theta$$

Here, the total light quantity from the light-source bulb B is given by $I_{tot}=\pi^2 I_0$.

With the above intensity distribution, let us derive the total light quantity Fn of light emitted into the range of angles $\theta_n$ to $\theta_{n+1}$. First, the luminous intensity In in this range is defined as an average of intensities at angles $\theta_n$ axis and $\theta_{n+1}$.

$$In = \{I(\theta_n) + I(\theta_{n+1})\}/2$$
$$= I_0(\sin\theta_n + \sin\theta_{n+1})/2$$

The solid angle don of this angular range on the entire periphery is given by the following.

$$d\omega n=2\pi(\cos \theta_n-\cos \theta_{n+1})$$

The total light quantity Fn is thus obtained by Fn=In×dωn.

When the region on the curved surface (the curved surface C in FIG. 5) in which the light in this emission angle range is incident is projected onto the reference plane normal to the optical axis Ax (Z-axis), the area Sn of the projected region on the reference plane is given as follows, where $L_n$ and $L_{n+1}$ are respective distances from the optical axis Ax on the reference plane to the positions at $\theta_n$ and $\theta_{n+1}$.

$$Sn=\pi(L_{n+1}^2-L_n^2)$$

From these, the luminous exitance M in this region on the curved surface C is calculated as follows.

$$Mn = Fn/Sn$$
$$= (\text{total light quantity of incident light})/$$
$$(\text{area on the reference plane})$$

In FIG. 4, the luminous exitances Ma to Me are determined for the respective regions Ra to Re as described above and the curve shape of the initial reference line 21 is set so that their values are constant. In this case, the resultant shape of the initial reference line 21 is concave when observed from the illuminant point F and the optical axis Ax, as illustrated in FIG. 4.

It is noted here that FIG. 4 and FIG. 5 show just an example of the light emission distribution and the calculation method of the luminous exitance M, the shape of the initial reference line, and so on as described above and that, depending upon various conditions such as the form of the light-source bulb, easiness of computation, etc., the above method can be modified by selecting computation with the intensity distribution according to the conditions and the preferred initial reference line shape based thereon. The number of divisional regions of each reference line in the determination of the luminous exitance M may be optionally set according to the individual conditions. In another method, they may also be set using a continuous luminous exitance function along the reference line.

[Surface Reference Line Creating Step] (Step 102)

Next, the surface reference lines 22 corresponding to the respective initial reference lines 21 are created from the plurality of initial reference lines 21 set in the initial reference line setting step 101.

The initial reference lines 21 described above were basically set according to the condition that the luminous exitances M in the respective portions were constant. The initial reference lines 21 are deformed or modified by imposing thereon the condition of satisfying the shape constraints from the body side, or the like, so as to create the surface reference lines 22 such as the surface reference lines $22_1$ to $22_8$ illustrated in FIG. 1. For example, with the concave shape of the initial reference line 21 as illustrated in FIG. 4, the reflector 1 projects toward the rear, and it can pose a problem in the decrease of depth of the lamp. Therefore, the initial reference lines 21 are deformed in consideration of the shape constraints including the thickness of the lamp and changes in the luminous exitances M in respective portions due to the deformation, so as to create the preferred surface reference lines 22 (deformation according to shape constraints).

In addition to this deformation according to the shape constraints, it is also necessary to deform or correct the reflective surface shape of each part of the reflective surface 10*a* (deformation according to the reflective surface shape). For example, the reference lines are deformed according to angles between incident rays and the reference lines.

Figure 6A:
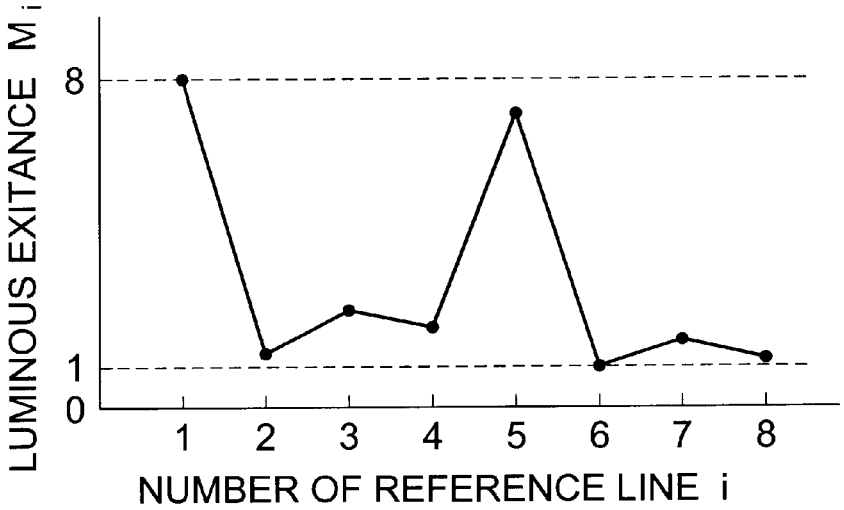
FIGS. 6A and 6B is graphs to show values of luminous exitances M on respective reference lines.

Further, the initial reference line setting step 101 described above takes note of only the constant condition of the luminous exitances M in the respective portions on each of the initial reference lines 21, but gives no consideration to the differences in the values of luminous exitances M among the different initial reference lines. Normally, the values have variations among the reference lines accordingly. FIG. 6A is a graph to show an example of distribution of values M1 to M8 of the luminous exitances on the respective reference lines $22_1$ to $22_8$ in this state. This graph shows each of the luminous exitances M1 to M8 normalized with respect to a minimum Mmin thereof at 1. The luminous exitances M compared herein among the reference lines are those on the respective, entire reference lines. However, the luminous exitances in the respective portions and in the whole are equal on each of the initial reference lines.

In this example, among the luminous exitances M on the whole lines, the maximum Mmax is the value on the first reference line, Mmax=M1, and the minimum Mmin is the value on the sixth reference line, Mmin=M6; thus, the ratio of them is Mmax/Mmin=8. This ratio is too large for the light uniformity of the vehicle lamp and, therefore, sufficient light uniformity cannot be achieved by this structure.

Figure 6B:
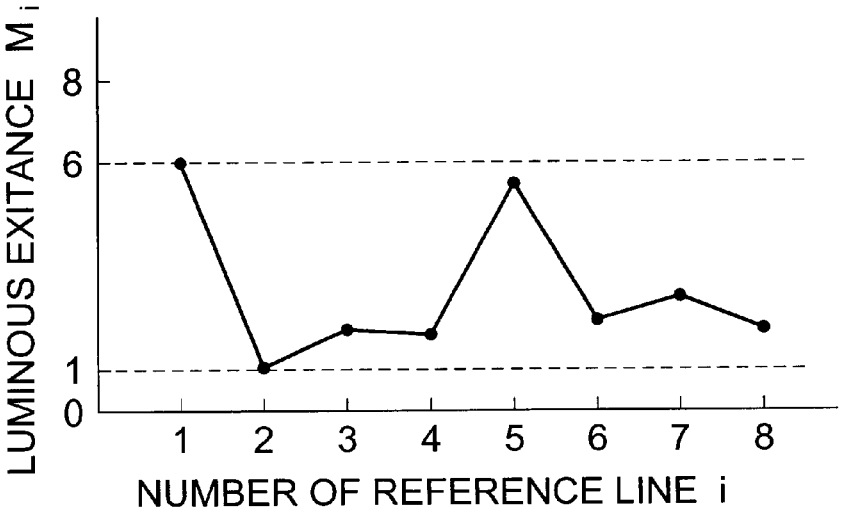

In such cases, the above ratio Mmax/Mmin=8 can be decreased by deformation of the initial reference lines 21 into the surface reference lines 22, for example, by deforming or modifying the reference line with the maximum or minimum luminous exitance M. In another method, the flow returns to the initial reference line setting step 101 and the initial reference lines 21 are again set under different conditions (resetting). By such deformation or resetting of the reference lines, the surface reference lines 22 are created so that Mmax/Mmin is in a suitable numerical range (deformation according to the luminous exitance ratio). Particularly, according to the results of studies and experiments by the inventor, the above suitable numerical range is preferably Mmax/Mmin≦6 as illustrated in FIG. 6B.

Figure 7:
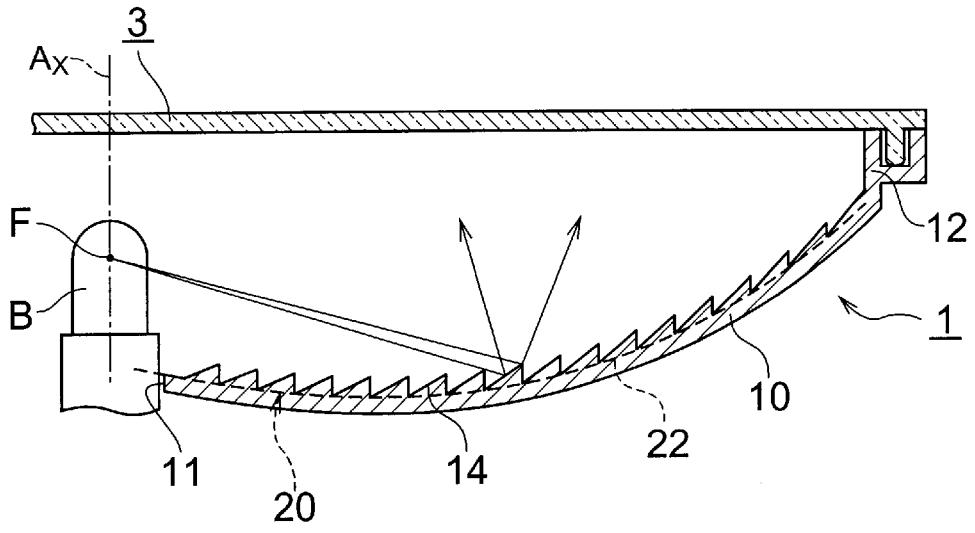
FIG. 7 is a cross-sectional view to show the surface reference lines and the free-formed surface of the reflector and the reflective surface elements formed on the free-formed surface.

Through the deformation as described above, the final surface reference lines 22 as indicated by a dashed line in FIG. 7 are obtained from the initial reference lines 21 as illustrated in FIG. 4. It is noted as to the above deformation steps according to the respective conditions that the order of the deformation steps etc. are not limited to those described above. In another potential method, the initial reference line setting step 101 is a step of determining whether ratios of luminous exitances among the initial reference lines satisfy the condition of Mmax/Mmin≦6 and repetitively carrying out the resetting when Mmax/Mmin>6, to finally determine the initial reference lines satisfying the condition of Mmax/Mmin≦6, and a step thereafter is a step of carrying out the deformation according to the shape constraints and the deformation according to the reflective surface shape in the surface reference line creating step 102. These deformations may also be carried out in connection with each other. Further, deformation can also be carried out according to constraints except for the above if necessary, or unnecessary deformation may be omitted.

[Free-formed Surface Creating Step] (Step 103)

Next, the free-formed surface 20 being the basic shape of the reflective surface 10*a* is created from the plurality of surface reference lines 22 created in the surface reference line creating step 102.

Figure 8:
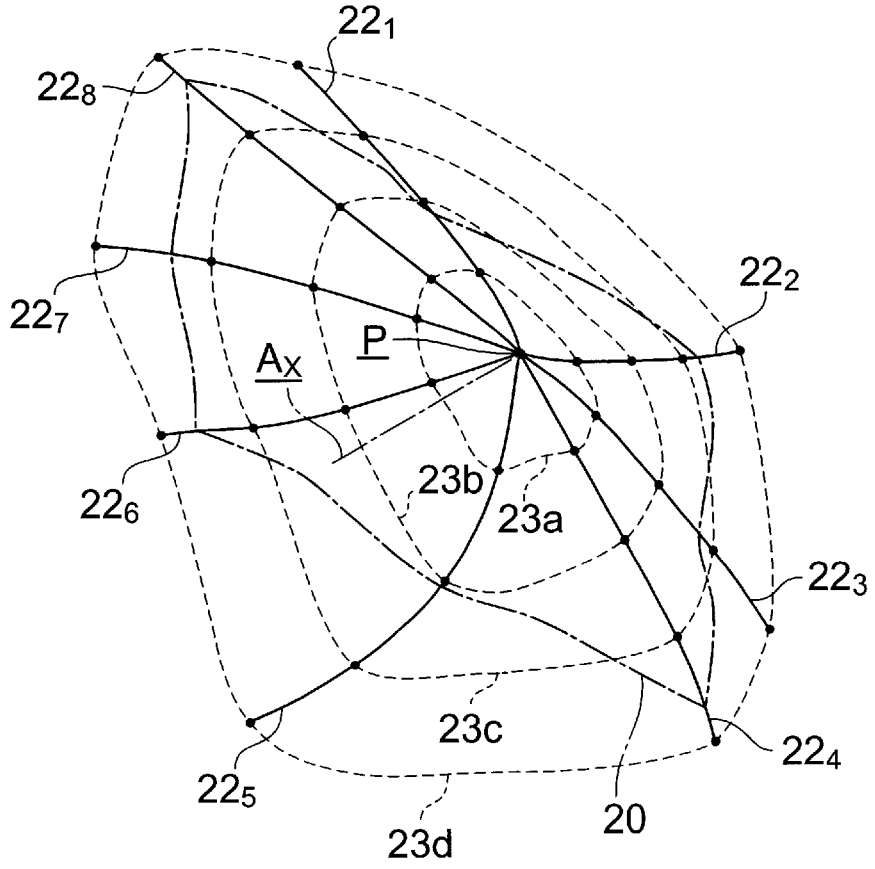
FIG. 8 is a perspective view to show a method of creating the free-formed surface.

FIG. 8 is a perspective view for explaining a creating method of the free-formed surface 20. This FIG. 8 shows the creation of the free-formed surface 20 used in the reflector 1 of FIG. 1. The outline shape (which is rectangular when viewed from the direction of the optical axis Ax) of the free-formed surface 20 illustrated in FIG. 1 is illustrated by the periphery thereof indicated by a dot-dashed line denoted by numeral 20 in FIG. 8. The surface reference lines $22_1$ to $22_8$ indicated by respective solid lines are equal to those indicated by the dashed lines in FIG. 1, in the curve region included in the free-formed surface 20 within the range where the reflective surface 10*a* is formed.

In the steps before the creation of the free-formed surface illustrated in FIG. 8, the curve regions of the surface reference lines $22_1$ to $22_8$ and the initial reference lines 21 as a basis thereof are set depending upon the conditions of easiness of creation of curved surface and the like. In FIG. 8, for each of the surface reference lines $22_1$ to $22_8$, the other end relative to the point P on the optical axis Ax being one end is set outside the range of the reflective surface 10*a* in order to make the range wider than the range of the reflective surface 10*a*. A portion within a predetermined region is cut out of the surface shape formed in this range, as indicated by the dot-dashed line in FIG. 8, and it is used as the free-formed surface 20, which is the basic shape of the reflective surface 10*a*.

It is desirable to employ a method of obtaining a smooth curved surface including the surface reference lines $22_1$ to $22_8$ as the creating method of the free-formed surface 20. In the creating method of the free-formed surface in the present embodiment illustrated in FIG. 8, each of the surface reference lines $22_1$ to $22_8$ is quartered into four divisional points (including the outside end point), and corresponding divisional points are grouped into sets of eight divisional points. Further, they are connected by smooth curves to determine free-formed curves 23*a*, 23*b*, 23*c*, and 23*d* of four closed curves (closed curves indicated by dashed lines connecting the divisional points in FIG. 8), and the free-formed surface 20 is created from a curved surface defined by these free-formed curves 23*a* to 23*d*.

The number of divisional segments of each surface reference line is not limited to four, but it may be properly selected as a dividing number m necessary for obtaining the free-formed surface of smooth shape in each case. In general, each of n (n is an integer not less than 3) surface reference lines is divided into m equal parts (m is an integer not less than 2) to create m divisional points (including the outside end point). Then sets of n corresponding divisional points are connected by m smooth, free-formed curves, respectively, and the free-formed surface can be created from these m free-formed curves in fashion similar to that in the example illustrated in FIG. 8.

Various methods normally used may be applied to the method of creating the closed curves by connecting the divisional points, the method of creating the curved surface including the free-formed curves of the closed curves, and so on. For example, a creating method of a closed curve is a method of creating points q1 to q8 by shifting a set of divisional points p1 to p8 each by a small distance, forming a curve smoothly connecting the sixteen points p1 to p8, q1 to q8 in order, and obtaining a closed curve from a portion of one round, for example, a curve from p5 to q5. The smooth connection in creation of the free-formed curves and the free-formed surface is preferably connection in the shape without steps etc., and can be obtained, for example, by use of spline curves or the like. The method may also be a free-formed surface creating method without use of free-formed curves.

[Reflective surface determining step] (Step 104)

The next step is a step of dividing the free-formed surface 20 created in the free-formed surface creating step 103, into an array of segments and forming the reflective surface 10*a* consisting of a plurality of reflective surface elements 14.

Figure 9:
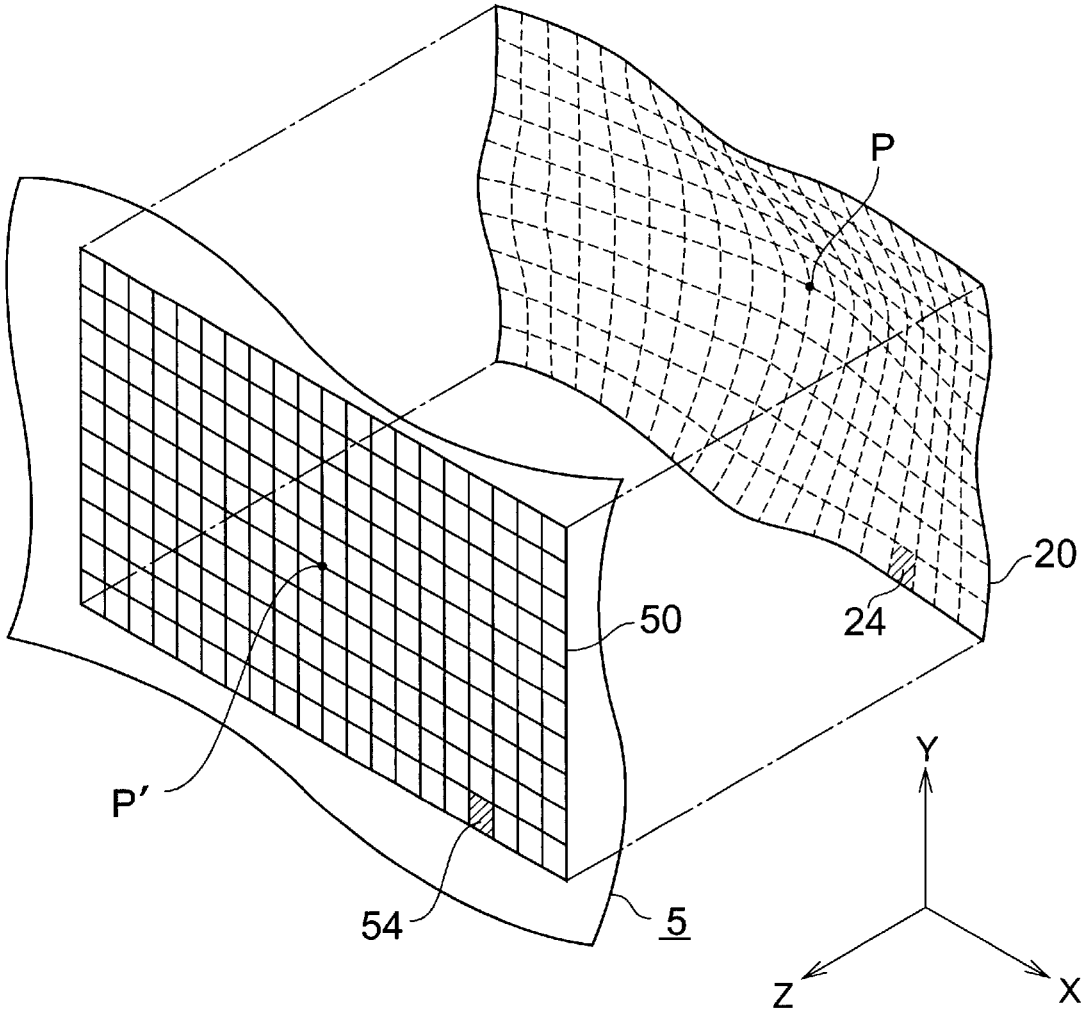
FIG. 9 is a perspective view to show a method of dividing the free-formed surface into an array of segments.

FIG. 9 is a perspective view to show a method of dividing the free-formed surface 20 into an array of segments. This array structure of segments corresponds to the structure of the reflective surface 10*a* illustrated in FIG. 2.

The creating method of the array of segments can be selected from various methods, including direct division of the region on the free-formed surface 20. In the present embodiment, as illustrated in FIG. 9, a reflective surface outline 50 is created on the reference plane 5 specified by the X-Y plane, about the center of point P' on the reference plane 5, corresponding to the point P on the optical axis Ax, and the division into segments is effected on the reflective surface outline 50.

Specifically, two dividing directions are determined along the X-axis direction and the Y-axis direction perpendicular to each other on the reflective surface outline 50, and the reflective surface outline 50 is divided at fixed intervals along each of the directions to create reference segments 54 arranged in an array pattern. Then the reference segments 54 are projected onto the free-formed surface 20 to obtain segments 24 arranged in an array pattern in a view from the Z-axis direction, as indicated by dashed lines on the free-formed surface 20 in FIG. 9.

Further, a reflective surface element 14 is assigned to each of the segments 24 on the free-formed surface 20, as illustrated in FIG. 2, so as to form the reflective surface 10*a* (reference is also made to the sectional shape of FIG. 7). The reference segment 54 and segment 24 hatched in FIG. 9 correspond to the reflective surface element 14 hatched in FIG. 2.

The reflective surface shape of each reflective surface element 14 formed in each segment 24 is determined as described with reference to FIG. 1 and FIG. 2; specifically, basic reflective surface shapes are paraboloids of revolution generated in respective, different, focal lengths with the center axis along the optical axis Ax and the focus at the illuminant point F (light source position), and the shapes of the paraboloids of revolution are deformed so as to yield the predetermined light diffusing capability, thereby determining the reflective surface shape of each reflective surface element 14. For the paraboloids of revolution as the basic reflective surface shapes, the focal length of each paraboloid of revolution is determined based on the illuminant point F and the optical axis Ax and on the position of the reflective surface element 14 on the free-formed surface 20 so that the incident light from the illuminant point F is reflected into the direction of the optical axis Ax.

Figure 10:
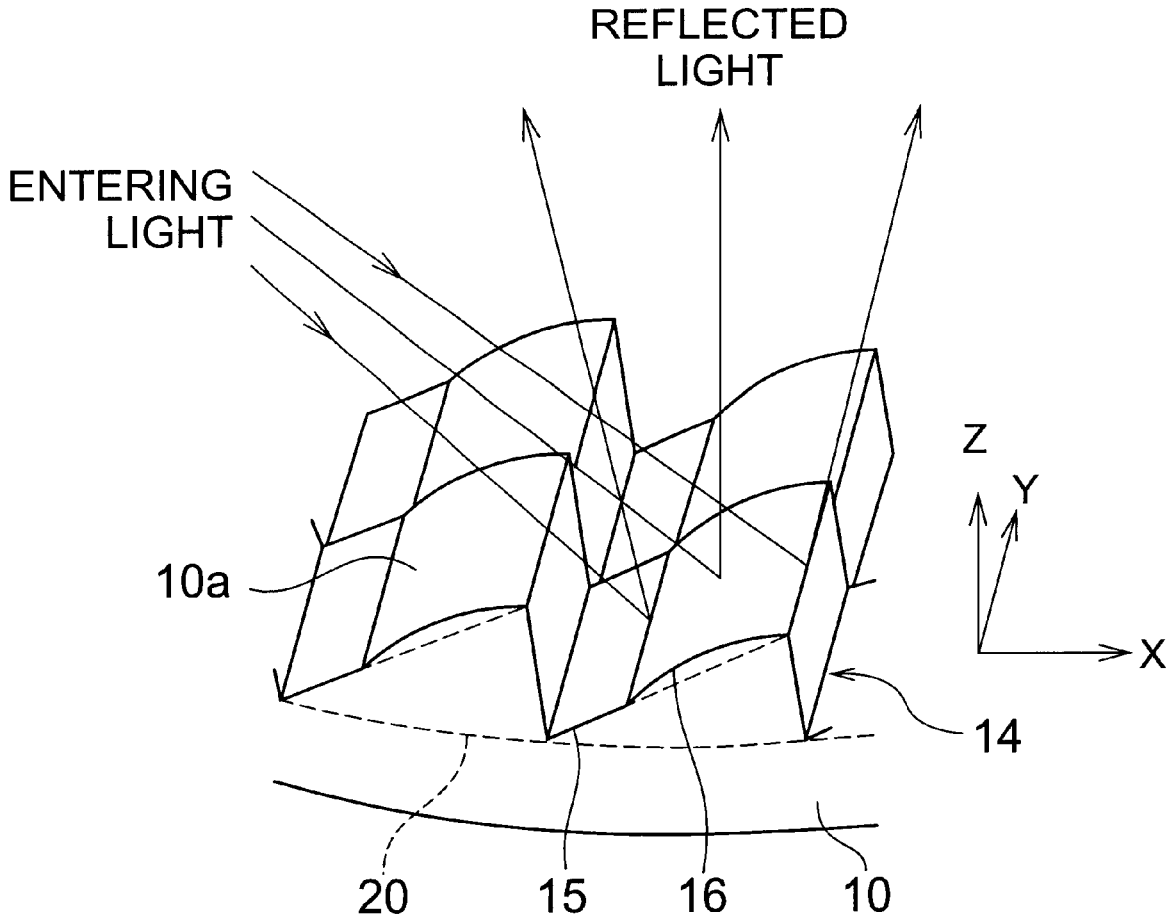
FIG. 10 is a perspective view to show an example of the structure of reflective surface elements.

FIG. 10 is a perspective view to show the reflective surface shape of the reflective surface elements 14, which are partly cut out of the reflector part 10 in the present embodiment. Each of the reflective surface elements 14 is comprised of a paraboloid part 15 formed in the aforementioned shape of paraboloid of revolution, and a diffuse reflection part 16 formed in the convex shape relative to the shape of paraboloid of revolution so as to yield the light diffusing capability.

The paraboloid part 15 is a portion behind the adjacent, reflective surface element 14 and an actually light-entering portion from the light-source bulb B is constructed as the diffuse reflection part 16. This diffuse reflection part 16 is formed in a cylindrical shape so as to yield the light diffusing capability only in the X-axis direction, so that the light is reflected in a nearly parallel light state in the Y-axis direction. In connection therewith, the lens 3 is of the structure having the lens steps 3*a* with the light diffusing capability in the Y-axis direction, as illustrated in FIG. 1, in the present embodiment.

The effects of the vehicle lamp in the above structure, and the reflective surface determining method thereof will be described below.

In the vehicle lamp and the reflective surface determining method according to the above embodiment, the light uniformity of the functional condition and the thin shape of the shape condition are set by the free-formed surface 20. Further, the light diffusibility of the functional condition and the transparency of the appearance condition are set by the reflective surface elements 14 formed corresponding to the respective segments obtained by dividing the free-formed formed surface 20 into the array pattern. This setup surely and efficiently realizes the structure of the vehicle lamp with transparent appearance and thin shape while achieving the improvement in both the functional conditions of light uniformity and light diffusibility.

When the basic shape of the reflective surface is the free-formed surface and, for example, in the case wherein the free-formed surface is divided into a plurality of portions about the optical axis by intersecting lines around the optical axis between the free-formed surface and a plurality of paraboloids of revolution with different focus lengths about the optical axis and wherein the reflective surface is formed by assigning corresponding paraboloids of revolution to the respective regions, it is also possible to provide each paraboloid of revolution with diffuse reflection steps. In this case, however, designing of the diffuse steps becomes complex, because of the shapes of the divisional regions of the reflective surface, which are beltlike regions around the optical axis. Particularly it is extremely difficult to set and control the diffuse reflection in the X-axis and Y-axis directions. Therefore, it is difficult to apply the lens with see-through nature while realizing the sufficient light diffusing function by the reflector in this structure.

In contrast to it, the above difficulties can be eliminated by using the reflective surface elements assigned to the array of segments, as the basic structure for the formation of the diffuse reflection steps. In the embodiment described above, the dividing directions into the array pattern are the X-axis and Y-axis directions, so as to facilitate the setting and control of the light diffusing function in the two directions, thereby realizing the applicable condition of the lens with see-through nature.

The luminous exitance M in each part is defined and used as an index for setting of the shape and reflection characteristics, concerning the shape of the reflective surface 10*a* and the free-formed surface 20, which can clarify the selection method of the forming conditions to satisfy the light uniformity, the comparison method of characteristics, etc. and which can make the design steps greatly easier and more efficient. Further, the shape is determined so that the numerical range of this luminous exitance M is Mmax/Mmin≦6, which can improve the compatibility between resultant light uniformity and the other characteristics.

The luminous exitance M is defined, specifically, using the reference plane 5 normal to the optical axis Ax. The reference plane 5 thus set is equivalent to the field where the lighting lamp is observed from the optical-axis direction, so that the luminous exitance M can be a suitable index for light uniformity in use of the lamp.

For the creation of the free-formed surface 20 and the reflective surface 10*a,* a plurality of initial reference lines are first set so that the luminous exitances M in the respective portions are constant, and then the free-formed surface is created via the surface reference lines. This permits the determining method of the reflective surface shape satisfying the light uniformity to be utilized as a reflective surface determining method facilitated and optimized in particular.

For example, it is also possible to employ a method of defining the reference lines used for the formation of the shape of the free-formed surface, as a plurality of curves extending along a predetermined axis, for example, along the Y-axis, setting the conditions of the luminous exitance M on the reference lines, deforming them, and thereafter connecting them in the perpendicular direction (for example, in the direction of the X-axis) to create the free-formed surface. This method, however, has problems on efficiency in determining the reflective surface; e.g., it is difficult to determine the suitable shape for each of the reference lines, condition setting and selection steps have to be repeated many times in order to create the free-formed surface with sufficient light uniformity, and so on.

In contrast to it, when the reference lines are defined as lines each extending radially from the optical axis as described above, this method can greatly simplify the design steps for matching the reflective surface shape with the shape conditions about the optical axis and the conditions for the light reflecting function, which realizes increase in the efficiency of determining the reflective surface and improvement in characteristics of the resultant shape of the reflective surface.

The vehicle lamp and the reflective surface determining method of the reflector thereof according to the present invention are not limited to the embodiment described above, but various changes and modifications can be made depending upon specific constraints and conditions imposed on individual lamps.

For example, the above embodiment employed the eight reference lines, i.e., the vertical, horizontal, and diagonal lines, as reference lines used for formation of the reflective surface, but, in the case where particularly severe shape constraints are imposed on a specific part of the reflector portion, the free- formed surface can be created efficiently by placing reference lines at and near that part. In other cases, it is preferable to select suitable reference lines in accordance with specific conditions for each lamp.

When the condition of Mmax/Mmin≦6 is applied to the luminous exitances M on the plurality of surface reference lines in the surface reference line creating step, the condition approximately complying with the condition of Mmax/Mmin≦6 can also be realized for the free-formed surface and the reflective surface created. Further, in the free-formed surface creating step or in the reflective surface determining step, the reflective surface shape may also be determined by further imposing the above condition on the luminous exitances M in the respective portions on the free-formed surface or on the reflective surface. In this case, it is also possible to carry out the setting of the initial reference lines or the creation of surface reference lines again if necessary.

The structure of each reflective surface element is not limited to that in the above embodiment. For example, the reflective surface elements may also be provided with light diffusing capability both in the X-axis direction and in the Y-axis direction. In this case, in connection therewith, the lens can be a stepless, see-through lens with little light diffusing capability, which can further enhance the transparency and deep look. The shape of the reflective surface can be any shape such as a plane or the like without having to be limited to the paraboloid of revolution. And the shape of the diffuse reflection regions can also be selected from various reflective surface shapes, such as the concave shape, combination of small curved surfaces, and so on, without having to be limited to the convex shape.

Further, the structure of the lamp other than the above can also be selected from various structures without having to be limited to the above embodiment. For example, the light-source bulb may be set while the center line thereof is inclined relative to the optical axis.

The vehicle lamp and the reflective surface determining method of the reflector thereof according to the present invention have the following effects, as detailed above. Namely, the reflective surface of the reflector is created by the combination of the free-formed surface with the array of reflective surface elements, whereby the light uniformity condition and the condition of decrease in depth are substantiated by the free-formed surface while the light diffusibility condition and the conditions of transparency and deep look are substantiated by the reflective surface elements with diffuse reflection capability. This layout is suitable for the formation of the reflective surface shape satisfying all the above conditions. Particularly, when the free-formed surface or the reflective surface is created so as to meet the condition of Mmax/Mmin≦6, using the luminous exitance M defined in the direction along the optical axis, as an index to evaluate the shape and characteristics, for the shape of the free-formed surface or the reflective surface, the lamp can be provided with improvement in characteristic conditions all together.

When a plurality of reference lines extending radially from the optical axis are used in the reflective surface determining method for it, the method can be a forming method capable of efficiently and surely implementing optimization of the shape of the curved surface. Namely, the creating method can be made largely efficient by first setting a plurality of initial reference lines so that the luminous exitances M in the respective portions are constant, and creating the free-formed surface via the surface reference lines in consideration of the condition of Mmax/Mmin≦6 from the initial reference lines.

The vehicle lamp of the above structure produced by the reflective surface determining method of the reflector is suitably realized and improved in the functional conditions of light uniformity and light diffusibility while being provided with transparent appearance and thin shape. Therefore, it can be applied as a marker lamp with transparency and a deep look. Since this structure is such that the lens is constructed of a single lens and in the relatively simple structure, and that the reflector is also constructed in the array structure relatively easy to make, the production cost of the lamp can also be reduced and thus an inexpensive marker lamp can be provided.

From the invention thus described, it will be obvious that the invention may be varied in many ways. Such variations are not to be regarded as a departure from the spirit and scope of the invention, and all such modifications as would be obvious to one skilled in the art are intended for inclusion within the scope of the following claims.

What is claimed is:

1. A method of determining a reflective surface of a reflector used in a vehicle lamp, comprising:

a condition setting step of setting a light source position at which a light source is to be placed, and an optical axis passing said light source position and defining a direction into which light from said light source is to be reflected by the reflector;

an initial reference line setting step of setting a plurality of initial reference lines each extending radially from a predetermined position on said optical axis so that on each of said initial reference lines luminous exitances M, specified in the direction along said optical axis for respective portions of said initial reference line, are constant;

a surface reference line creating step of creating a plurality of surface reference lines by deforming said plurality of initial reference lines so as to satisfy the condition of Mmax/Mmin≦6 as to a maximum Mmax and a minimum Mmin on said plurality of initial reference lines out of luminous exitances M for the respective, entire, initial reference lines, and a predetermined shape constraint;

a free-formed surface creating step of creating a free-formed surface comprising said plurality of surface reference lines; and a reflective surface determining step of dividing said free-formed surface into an array of segments and assigning a reflective surface element having a diffuse reflection region for diffusely reflecting the light from said light source position, to each of said segments, thereby determining a reflective surface comprising a plurality of said reflective surface elements.

2. The method according to claim 1, wherein said free-formed surface creating step comprises a step of creating said free-formed surface so as to satisfy the condition of Mmax/Mmin≦6 as to a maximum Mmax and a minimum Mmin out of luminous exitances M for respective portions on said free-formed surface.

3. The method according to claim 1, wherein said reflective surface determining step comprises a step of determining said reflective surface so as to satisfy the condition of Mmax/Mmin≦6 as to a maximum Mmax and a minimum Mmin out of luminous exitances M for respective portions on said reflective surface.

4. The method according to claim 1, wherein said initial reference line setting step comprises a step of determining whether the condition of Mmax/Mmin≦6 is met as to the maximum Mmax and the minimum Mmin on said plurality of initial reference lines out of the luminous exitances M for the respective, entire, initial reference lines and resetting said plurality of initial reference lines when Mmax/Mmin>6.

5. The method according to claim 1, wherein said free-formed surface creating step comprises a step of dividing each of n (n is an integer not less than 3) said surface reference lines into m equal parts (m is an integer not less than 2) to create m divisional points, connecting n corresponding divisional points on the respective surface reference lines to obtain m free-formed curves, and creating said free-formed surface comprising said m free-formed curves.

6. A vehicle lamp comprising a light source, a reflector having a reflective surface comprising a plurality of reflective surface elements for reflecting light from said light source into a direction along a predetermined optical axis, and a lens which transmits the light reflected by said reflector, wherein said reflective surface is formed by assigning said reflective surface elements to respective segments obtained by dividing a free-formed surface satisfying a predetermined shape constraint, into an array pattern, and each of said plurality of reflective surface elements has a diffuse reflection region for diffusely reflecting the light from said light source, and wherein said free-formed surface satisfies the condition of Mmax/Mmin≦6 as to a maximum Mmax and a minimum Mmin out of luminous exitances M specified in the direction along said optical axis for respective portions on said free-formed surface.

7. The vehicle lamp according to claim 6, wherein said segments are formed by dividing said free-formed surface into the array pattern along a first direction substantially normal to said optical axis and along a second direction substantially normal to each of said optical axis and said first direction, wherein each of said plurality of reflective surface elements has said diffuse reflection region for diffusely reflecting the light from said light source in said first direction, and wherein said lens has a lens step structure for diffusing the light from said light source, having been reflected by said reflective surface, in said second direction.

8. The vehicle lamp according to claim 6, wherein said segments are formed by dividing said free-formed surface into the array pattern along a first direction substantially normal to said optical axis and along a second direction substantially normal to each of said optical axis and said first direction, and wherein each of said plurality of reflective surface elements has said diffuse reflection region for diffusely reflecting the light from said light source in said first direction and in said second direction.

9. A vehicle lamp comprising a light source, a reflector having a reflective surface comprising a plurality of reflective surface elements for reflecting light from said light source into a direction along a predetermined optical axis, and a lens which transmits the light reflected by said reflector, wherein said reflective surface is formed by assigning said reflective surface elements to respective segments obtained by dividing a free-formed surface satisfying a predetermined shape constraint, into an array pattern, and each of said plurality of reflective surface elements has a diffuse reflection region for diffusely reflecting the light from said light source, and wherein said reflective surface comprising said plurality of reflective surface elements satisfies the condition of Mmax/Mmin≦6 as to a maximum Mmax and a minimum Mmin out of luminous exitances M specified in the direction along said optical axis for respective portions on said reflective surface.

10. The vehicle lamp according to claim 9, wherein said segments are formed by dividing said free-formed surface into the array pattern along a first direction substantially normal to said optical axis and along a second direction substantially normal to each of said optical axis and said first direction, wherein each of said plurality of reflective surface elements has said diffuse reflection region for diffusely reflecting the light from said light source in said first direction, and wherein said lens has a lens step structure for diffusing the light from said light source, having been reflected by said reflective surface, in said second direction.

11. The vehicle lamp according to claim 9, wherein said segments are formed by dividing said free-formed surface into the array pattern along a first direction substantially normal to said optical axis and along a second direction substantially normal to each of said optical axis and said first direction, and wherein each of said plurality of reflective surface elements has said diffuse reflection region for diffusely reflecting the light from said light source in said first direction and in said second direction.

* * * * *